US011646145B2

(12) United States Patent
Sheehan et al.

(10) Patent No.: US 11,646,145 B2
(45) Date of Patent: May 9, 2023

(54) LOW-PROFILE HOUSING FOR ELECTRONIC COMPONENTS

(71) Applicant: BOURNS, INC., Riverside, CA (US)

(72) Inventors: Cathal Sheehan, Douglas (IE); Tom Hennessy, Sheepwalk (IE)

(73) Assignee: Bourns, Inc., Riverside, CA (US)

( * ) Notice: Subject to any disclaimer, the term of this patent is extended or adjusted under 35 U.S.C. 154(b) by 778 days.

(21) Appl. No.: 16/669,442

(22) Filed: Oct. 30, 2019

(65) Prior Publication Data

US 2020/0143971 A1 May 7, 2020

Related U.S. Application Data

(60) Provisional application No. 62/754,413, filed on Nov. 1, 2018.

(51) Int. Cl.

| | |
|---|---|
| ***H01F 27/02*** | (2006.01) |
| ***H01F 27/28*** | (2006.01) |
| ***H01F 27/29*** | (2006.01) |

(52) U.S. Cl.

CPC ..... *H01F 27/02* (2013.01); *H01F 27/2823* (2013.01); *H01F 27/29* (2013.01)

(58) Field of Classification Search

CPC ..... H01F 27/02; H01F 27/2823; H01F 27/29; H01F 2027/297; H01F 2027/065; H01F 27/2828; H01F 27/306

See application file for complete search history.

(56) References Cited

U.S. PATENT DOCUMENTS

| | | | | |
|---|---|---|---|---|
| 6,753,749 | B1 | 6/2004 | Chin | |
| 8,049,590 | B2 | 11/2011 | Huh et al. | |
| 8,344,839 | B2 | 1/2013 | Faccin | |
| 9,271,414 | B2 | 2/2016 | Maier et al. | |
| 9,646,755 | B2 * | 5/2017 | Lint | H01F 27/02 |
| 10,600,563 | B2 * | 3/2020 | Jang | H01F 27/02 |
| 2013/0092411 | A1 | 4/2013 | Chen et al. | |
| 2014/0306785 | A1 | 10/2014 | Maier et al. | |
| 2017/0338022 | A1 | 11/2017 | Lint | |

FOREIGN PATENT DOCUMENTS

| | | | |
|---|---|---|---|
| CN | 102592804 | A | 7/2012 |
| CN | 107393681 | A | 11/2017 |
| DE | 19641388 | A1 | 4/1998 |

OTHER PUBLICATIONS

Office Action in Chinese Application No. 201980078013.1 dated Mar. 3, 2022 in 9 pages.

* cited by examiner

*Primary Examiner* — Tuyen T Nguyen

(74) *Attorney, Agent, or Firm* — Knobbe, Martens, Olson & Bear, LLP

(57) ABSTRACT

A low-profile high minimum creepage housing for electronic components such as transformers is provided. The housing can include a body and a lid. The lid can have attachment members that secure the lid to the body, after an electronic component is installed into the body. The attachment members of the lid may also secure a wire routed along the outside of the body against the body. The lid may include protruding portions that extend into the body, thereby elongating a minimum creepage path.

25 Claims, 16 Drawing Sheets

LOW-PROFILE HOUSING FOR ELECTRONIC COMPONENTS

CROSS-REFERENCE TO RELATED APPLICATIONS

This application claims the priority benefit of U.S. Provisional Patent Application No. 62/754,413 filed on Nov. 1, 2018, entitled "LOW-PROFILE HIGH-CREEPAGE HOUSING," which is incorporated by reference herein in its entirety.

BACKGROUND

Field

The field relates to housings for electronic components such as transformers.

Description of the Related Art

Electronic components such as transformers are closely regulated and must satisfy various standards. As examples, regulations generally require electronic components to have minimum creepage and clearance distances. Minimum creepage is the shortest path between two conductive parts measured along the surface of insulation between the two conductive parts. Minimum clearance is the shortest path between two conductive parts as measured through the air.

The requirements to provide minimum creepage and clearance distances often conflict with the desire to provide small form factor devices. Minimum creepage and clearance distances can be satisfied by elongating parts to increase the path between two conductive parts. Small form factor devices can achieve minimum creepage and clearance distances through potting (e.g., filling voids in the device with an insulating compound such as epoxy) however potting significantly increases the cost of such devices. Accordingly, there remains a need for electronic components having a small form factor that can satisfy minimum creepage and clearance distances.

SUMMARY

In one aspect, a low-profile electronic component housing includes: a body including a cavity; an electronic component housed in the cavity of the body; a lid secured to the body, the lid including an extension portion that extends into the cavity of the body from a lateral portion of the lid; a wire; and a terminal electrically coupled to the electronic component by way of the wire, wherein a minimum creepage path is disposed between the terminal and the electronic component, the minimum creepage path including a distance between the terminal and the electronic component as measured along a surface of insulation, and wherein the minimum creepage path extends along the extension portion of the lid.

In some embodiments, the electronic component includes a wire-wound electronic component. The wire-wound electronic component can be a transformer. The minimum creepage path can extend between the extension portion and the body. The wire can be routed along a lateral side of the electronic component housing. The wire can be routed into the cavity through a side opening disposed on the lateral side of the electronic component housing. No terminals can be disposed along the lateral side of the electronic component housing. The body may further include a sidewall. The sidewall and the extension portion may extend vertically in opposing directions.

The extension portion may include two rounded wall portions extending from two ends of a center wall portion. The sidewall may include two rounded sidewall portions extending from two ends of a center sidewall portion. The two rounded wall portions of the extension portion may be configured to mate with the two rounded sidewall portions of the sidewall and the center wall portion of the extension portion can be configured to mate with the center sidewall portion of the sidewall. The electronic component housing may have a front side disposed non-parallel relative to the lateral side, wherein the sidewall and the lid cooperate to define a front opening in the front side which exposes the electronic component to an exterior of the electronic component housing.

The electronic component housing can include another terminal including a plurality of pins disposed along the front side of the electronic component housing.

In some embodiments, the lid may further include a locking feature that secures the lid to the body and at least partially secures the wire against a portion of the body. The minimum creepage path may have a length of at least 8.0 mm. The housing may have a height of 7.5 mm or less, a depth of 12.5 mm or less, and a width of 11 mm or less. The wire can include an insulated wire. The insulated wire can be triple insulated wire.

In another aspect, a low-profile electronic component housing includes: a body having a base and a sidewall extending non-parallel relative to the lateral base; an electronic component housed within a cavity of the body; a lid secured to the body, the lid comprising an extension portion extending towards the body along the sidewall from a lateral portion of the lid; and a terminal electrically coupled to the electronic component by way of a wire.

In some embodiments, the electronic component includes a wire-wound electronic component. The wire-wound electronic component can be a transformer. The extension portion and the sidewall can be at least partially disposed around the electronic component. The low-profile electronic component housing can include another terminal electrically coupled to the electronic component. The another terminal can be disposed along a front side of the housing, the front side can include a front opening that exposes the electronic component to an exterior of the housing. The another terminal can be electrically coupled to the electronic component through the front opening.

The wire can be routed along a lateral side of the housing and may extend into the housing through a side opening in the lateral side of the housing, the lateral side disposed non-parallel relative to the front side. The lid can at least partially secures the wire to the body. The lid can include at least one tab which secures the wire between the tab and the body when the lid is secured to the body. The at least one tab can include two tabs located at adjacent corners of the lid. The wire can include two wires which are routed along opposite sides of the body and wherein each tab is configured to secure a different wire to a different side of the body.

The lid can include a locking mechanism that secures the lid to the body and at least partially secures the wire against a portion of the body. The wire can be an insulated wire. The insulated wire can be triple insulated wire. The extension portion and the sidewall may be vertically formed. The terminal may be positioned on a side of the extension portion and sidewall that is opposite the cavity.

In another aspect, a low-profile electronic component housing, includes: a body having a base and a sidewall disposed non-parallel relative to the base; an electronic component housed within the cavity; a lid secured to the body over the cavity and the electronic component, the lid comprising an engagement member that extends towards the base from a lateral portion of the lid; and a wire extending through a side opening between the engagement member and the sidewall.

In some embodiments the low-profile electronic component housing can include a terminal electrically coupled to the electronic component by way of the wire.

All of these embodiments are intended to be within the scope of the invention herein disclosed. These and other embodiments will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Specific implementations of the invention will now be described with reference to the following drawings, which are provided by way of example, and not limitation.

DETAILED DESCRIPTION

Figure 1:
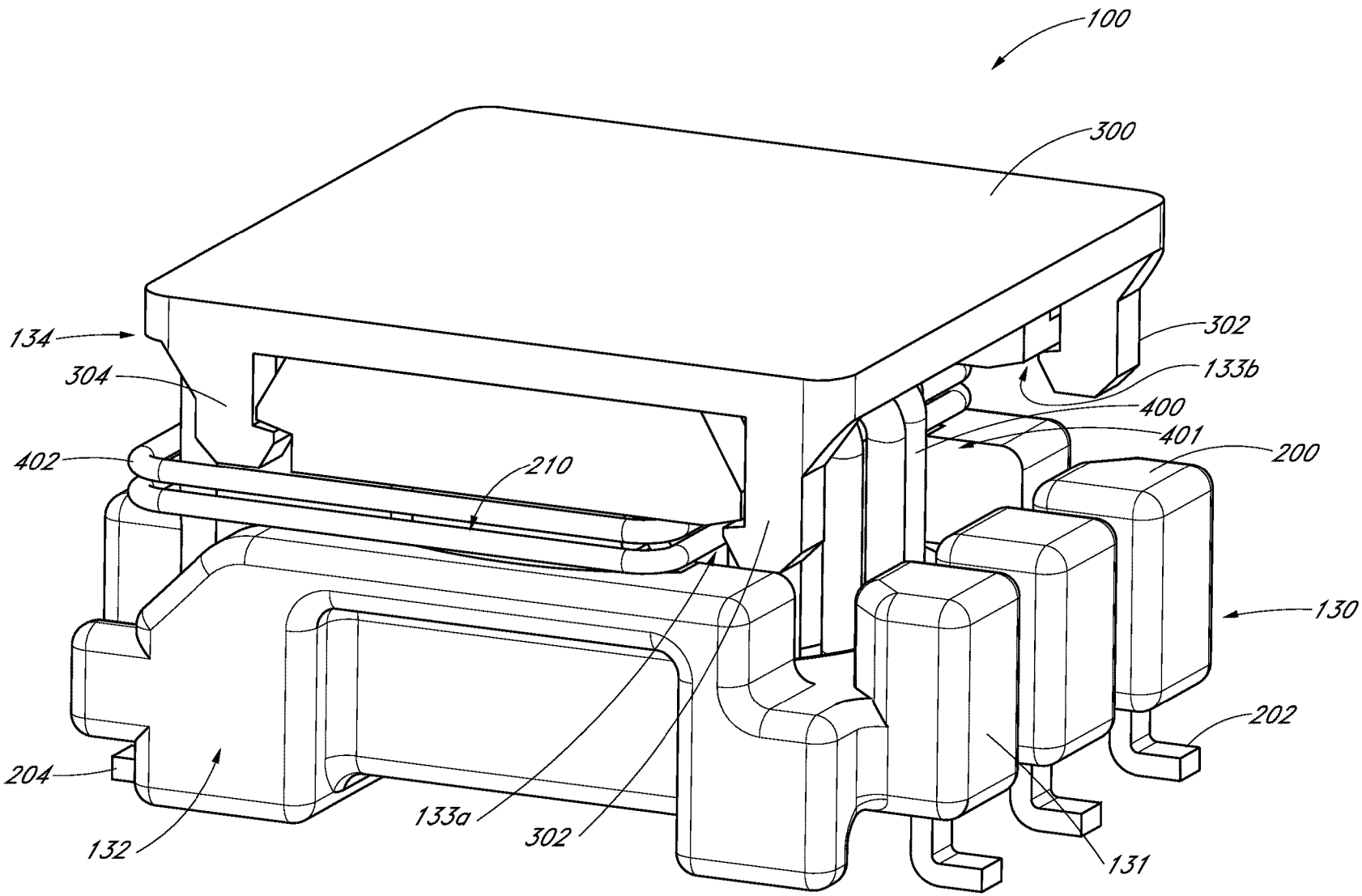
FIG. 1 is a front perspective view of an electronic component housing with an installed electronic component, according to various embodiments.

Various embodiments disclosed herein relate to a housing for an electronic component, the housing having both a low profile and high minimum creepage path. The housing may include an electronic component (or components), for example, a transformer in some embodiments. The electronic components and accompanying housing typically may be subject to regulatory requirements on minimum creepage for safety and proper operation. As an example, the housing may house a transformer and the housing may provide sufficient minimum creepage and clearance distances to satisfy regulatory requirements for operation of the transformer within specified operating parameters (e.g., for a specified working voltage, for specified environmental conditions, etc.), while still meeting customer demands for small form factors. The housing may include one or more features or structures that increase the minimum creepage and/or clearance distances, within a compact design.

Minimum creepage is the shortest path between two conductive parts measured along the surface of insulation between the two conductive parts. A proper and sufficient minimum creepage distance should protect against tracking, which is a failure mode in which an insulation surface is degraded and made at least partially conducting. Damage to insulators from tracking generally develops over time and is accelerated by various factors including excessive working voltages, humidity in the environment, contaminants in or on the insulators, corrosive materials or other pollutants including dust in the environment, humidity and moisture levels, and even the altitude at which the electronic component is operated. Thus, the minimum creepage distance specified by regulators is a function of multiple factors including, but not necessarily limited to, the expected working voltage, the insulator material properties, and the expected working environment (e.g., dry, wet, clean, dusty, salinity, corrosive, high or low altitude, etc.).

The expected working environment may sometimes be categorized according to pollution degrees. The first pollution degree may include environments with no pollution or only dry and non-conductive pollution (e.g., pollution having no influence on tracking). The second pollution degree may include environments that normally include only non-conductive pollution, but with tolerance for occasional temporary conductivity caused by condensation (some standards state condensation is acceptable only when the device is not operating). The third pollution degree includes environments with conductive pollution or dry non-conductive pollution that is allowed to become conductive due to condensation. The fourth pollution degree includes environments with persistent conductivity caused by conductive dust, rain, snow, or other such pollutants.

The resistance of an insulating material to tracking may be described by a comparative tracking index (CTI), determined by placing a test voltage across the insulator until a certain amount of current flows across the insulator. Materials having a higher CTI-value are more resistant to tracking and thus require shorter minimum creepage distances to satisfy regulations. Some materials, including inorganics like glass and ceramic, are not susceptible to tracking. In generally, plastics like polyethylene are more resistant to tracking than printed circuit board material (e.g., FR4 glass-reinforced epoxy laminate material), which is turn is more resistant to tracking than glass-filled PCB FR4, which is turn is more resistant to tracking than phenolic resins.

In contrast with minimum creepage, minimum clearance is the shortest through-the-air path between two conductive parts. Like minimum creepage, the minimum clearance distances specified by regulators depend on multiple factors including, but not necessarily limited to, the expected working voltage and the expected working environment (e.g., dry, wet, clean, dusty, corrosive, high or low altitude, etc.).

In at least some embodiments, the housing described herein is configured with a minimum creepage path of at least 9.2 mm, which may exceed the distance specified for a working voltage of 400V with the expected operating environment and insulator materials. At the same time, the housing may have compact dimensions including a height of approximately 6.8 mm (or 7.0 mm), a depth of approximately 12.1 mm, and a width of 10.4 mm. In some embodiments, the housing may have a height of 8.0 mm or less, 7.5 mm or less, 7.0 mm or less, 6.5 mm or less, 6.0 mm or less, between 7.5 and 8.0 mm, between 7.0 and 7.5 mm, between 6.5 and 7.0 mm, or between 6.0 and 6.5 mm. At the same time, the housing may have a depth of 13.0 mm or less, 12.5 mm or less, 12.0 mm or less, 11.5 mm or less, 11.0 mm or less, 10.5 mm or less, between 12.5 and 13.0 mm, between 12.0 and 12.5 mm, between 11.5 and 12.0 mm, between 11.0 and 11.5 mm, or between 10.5 and 11.0 mm. Additionally, the housing may have a width of 11.5 mm or less, 11.0 mm or less, 10.5 mm or less, 10.0 mm or less, 9.5 mm or less, 9.0 mm or less, between 11.0 and 11.5 mm, between 10.5 and 11 mm, between 10.0 and 10.5 mm, between 9.5 and 10.0 mm, or between 9.0 and 9.5 mm. Furthermore, the housing may have such dimensions while maintaining minimum creepage paths of at least 7.0 mm, at least 7.5 mm, at least 8.0 mm, at least 8.5 mm, at least 9.0 mm, at least 9.5 mm, at least 10.0 mm, between 7.0 and 7.5 mm, between 7.5 and 8.0 mm, between 8.0 and 8.5 mm, between 8.5 and 9.0 mm, between 9.0 and 9.5 mm, or between 9.5 and 10.0 mm.

FIG. 1 is a front perspective view of an electronic component housing 100 according to one exemplary embodiment. As shown in FIG. 1, the housing 100 may include a body portion 200 and a lid portion 300. In some embodiments, the lid portion 300 is removably coupled to the body portion 200 via engagement members 302 and 304 of the lid portion 300. The engagement members 302 and 304 engage with respective engagement portions of the body portion 200. In some embodiments, the engagement members 302, 304 may engage with the body portion 200 by way of a tool-less connection, e.g., a snapfit connection. In some embodiments, an adhesive may be used to assist in securing the lid portion 300 to the body portion 200. In various embodiments, the lid portion 300 may be more permanently secured to the body portion 200 (e.g., following installation of component 400). The body portion 200 and lid portion 300 may be formed from any desired material, including plastic.

The housing 100 may house an electronic component 400 such as a wire-wound electronic component, which can be connected to external circuitry (e.g., other electronic devices, a package substrate such as a printed circuit board, or any other suitable external device) via terminals or pins 202 and 204. The wire-wound electronic component can be a transformer 400. In other embodiments, the electronic component 400 may comprise other types of electronic devices. Pins 202 may be coupled to primary windings of the transformer 400, while pins 204 may be coupled to secondary windings of the transformer 400. In general, references herein to primary and secondary may be used interchangeably (e.g., the secondary side may, if desired, be operated as the primary side and the primary side may be operated as the secondary side). Pins 204 can be the first terminal and pins 202 can be the second terminal.

In various embodiments, transformer 400 may be inserted into the body portion 200 while the lid portion 300 is removed. The lid portion 300 may be secured to the body portion 200 after the transformer 400 is inserted into the cavity between the lid and body portions. In some embodiments, a front opening 401 in a front side 130 of the housing 100 may be provided which exposes the electronic component to an exterior of the electronic component housing. The front opening 401 provides benefits such as permitting the evaporation of liquids used during assembly (such as a post soldering wash). In other embodiments, however, the front side 130 may not include the front opening but may instead by closed, e.g., by providing a wall between pillars 131 connected to pins 202 and the transformer 400. Additionally, the design of housing 100 may at least partially protect the wire 402 from solder heat when, for example, the pins 202, 204 are soldered to an external device such as a package substrate. As shown, the pins 202 may be disposed along the front side 130 of the housing 100, e.g., the same side as the front opening 401.

Figure 3B:
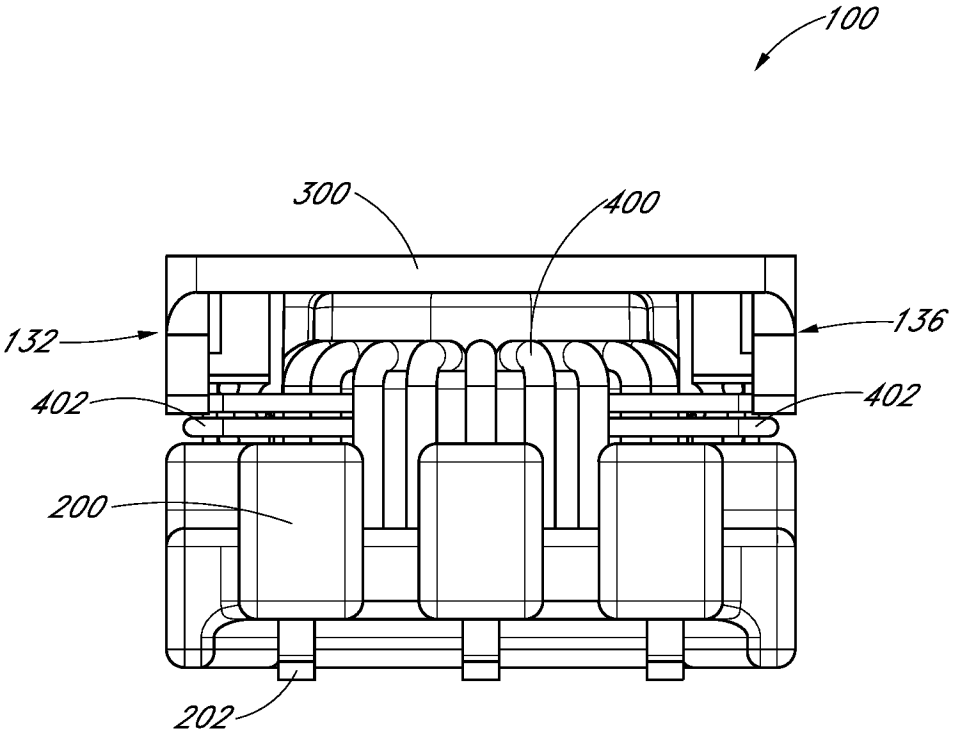
FIGS. 3A-3F show various schematic diagrams of the electronic component housing of FIG. 1.

FIG. 1 also illustrates a wire 402 that is routed along a lateral side 132 of the housing 100. The lateral side 132 of the housing can be non-parallel to (e.g., generally perpendicular to) the front side 130 and disposed between the front side 130 and a rear side 134 opposite the front side 130. The wire 402 may be an insulated wire such as a triple insulated wire. The wire 402 may include multiple triple insulated wires and may also include a combination of triple insulated wires and other types of wires. The wire 402 may be coupled to pins 204 and routed from the rear side 134 of the housing 100. The wire 402 may be coupled to the transformer and may run from the cavity of the housing 100 through a side opening 133*a* of the housing 100 along the lateral side 132. The side opening 133*a* may be disposed on a lateral side of the housing (e.g., lateral side 132 or 136) in which no terminals or pins are provided. Providing the side opening on a side without terminals can beneficially maintain a large minimum clearance. As shown in FIG. 3B, a second side opening 133*b* can be provided through the opposing lateral side 136 of the housing 100, which may also be void of terminals or pins.

In some embodiments, body portion 200 may have a groove 210 and the wire 402 may be disposed within the groove 210. The lid portion 300 may protect and/or secure wire 402 in place. As an example, engagement member 302 of the lid portion 300 may, in addition to securing lid portion 300 to body portion 200, serve as a locking feature that secures the wire 402 in place when the lid portion 300 is secured to the body portion 200. While FIG. 1 illustrates groove 210 on one lateral side 132 of the housing 100, a similar groove (and second wire) may be disposed on the other opposing lateral side 136 (see FIG. 3B) of the housing 100. If desired, both of the engagement members on the front portion of the lid portion 300 may be engagement members 302 and can secure wire 402 in place, thus allowing users to select a desired side of the housing 100 for running the wire 402 and permitting users to route wires 402 along both sides of the housing 100.

Figure 2:
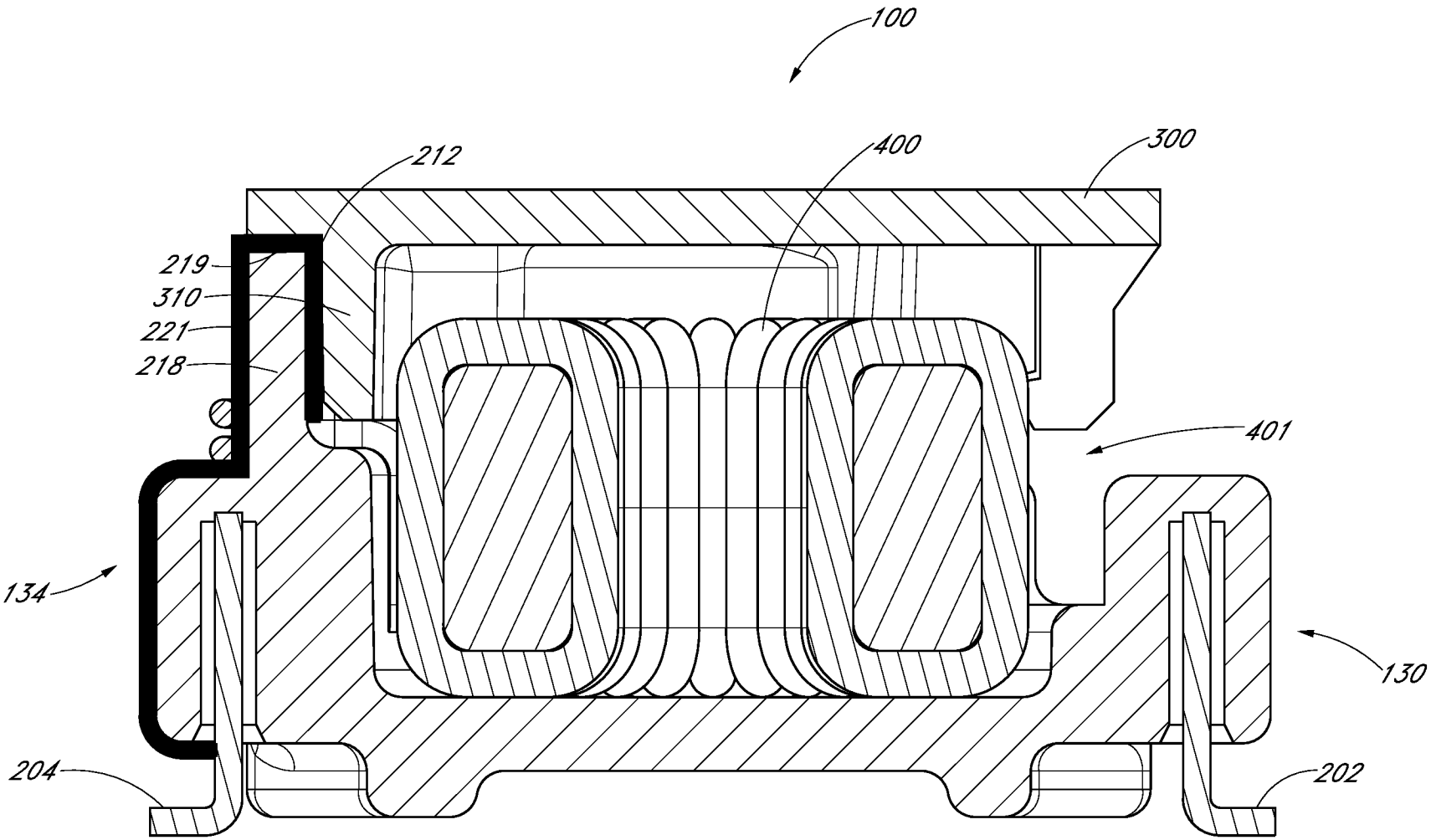
FIG. 2 is a cross-sectional side view of the electronic component housing of FIG. 1 with a transformer disposed therein, and also schematically showing a minimum creepage path.

FIG. 2 is a cross sectional view of the housing 100 with an electronic component comprising a transformer 400 housed within the housing 100. The bolded line connecting the pins 204 to the transformer 400 illustrates the minimum creepage path 212 in housing 100. As described previously, typically, the minimum creepage path 212 is designed to be sufficiently long so as to satisfy regulatory requirements on minimum creepage for safety and proper operation. In some embodiments, lid portion 300 may include an extension 310 that causes the minimum creepage path 212 to meander, thereby significantly increasing the length of the minimum creepage path. Further, the body portion 200 includes a vertically formed sidewall 218 which is shaped to fit flush with or adjacent to the extension 310 such that the sidewall 218 extends along a length of the extension portion 310. The Pins 204 can be positioned on a side of the extension portion 310 and sidewall 218 that is opposite a cavity 234 of the body portion 200. Advantageously by including the extension 310 to the lid portion 300 and corresponding vertically formed sidewall 218, the minimum creepage path 212 is extended without increasing the form factor of the overall device. For example, the extension 310 can vertically overlap the sidewall 218, such that the minimum creepage path 210 extends vertically upward between the extension 310 and the sidewall 218, over an upper rim 219 of the body portion 200 and along an exterior side surface 221 of the body portion 200.

In some embodiments, the minimum creepage path 212 may be at least 7.0 mm, at least 7.5 mm, at least 8.0 mm, at least 8.5 mm, at least 9.0 mm, at least 9.5 mm, at least 10.0 mm, between 7.0 and 7.5 mm, between 7.5 and 8.0 mm, between 8.0 and 8.5 mm, between 8.5 and 9.0 mm, between 9.0 and 9.5 mm, or between 9.5 and 10.0 mm. In some embodiments, the minimum creepage path may be 9.2 which can be higher than a minimum requirement of 8.0 mm of minimum creepage path for working voltages of 400V. Without the extension 310 of lid portion 300, the minimum creepage path length may be reduced to approximately 5.5 mm, which may be below the minimum requirement of 8.0 mm of minimum creepage path for working voltages of 400V.

In some embodiments, the height of the housing is 8.0 mm or less, 7.5 mm or less, 7.0 mm or less, 6.5 mm or less, 6.0 mm or less, between 7.5 and 8.0 mm, between 7.0 and 7.5 mm, between 6.5 and 7.0 mm, or between 6.0 and 6.5 mm. The housing may have a depth of 13.0 mm or less, 12.5 mm or less, 12.0 mm or less, 11.5 mm or less, 11.0 mm or less, 10.5 mm or less, between 12.5 and 13.0 mm, between 12.0 and 12.5 mm, between 11.5 and 12.0 mm, between 11.0 and 11.5 mm, or between 10.5 and 11.0 mm. Additionally, the housing may have a width of 11.5 mm or less, 11.0 mm or less, 10.5 mm or less, 10.0 mm or less, 9.5 mm or less, 9.0 mm or less, between 11.0 and 11.5 mm, between 10.5 and 11 mm, between 10.0 and 10.5 mm, between 9.5 and 10.0 mm, or between 9.0 and 9.5 mm. In some embodiments, the housing may have compact dimensions including a height of approximately 6.8 mm (or 7.0 mm), a depth of approximately 12.1 mm, and a width of approximately 10.4 mm.

FIGS. 3A-3F illustrate various schematic diagrams of the housing 100 from FIG. 1. FIGS. 3A-3F show similar features as are described in FIG. 1 and will not be repeated in detail.

Figure 3A:
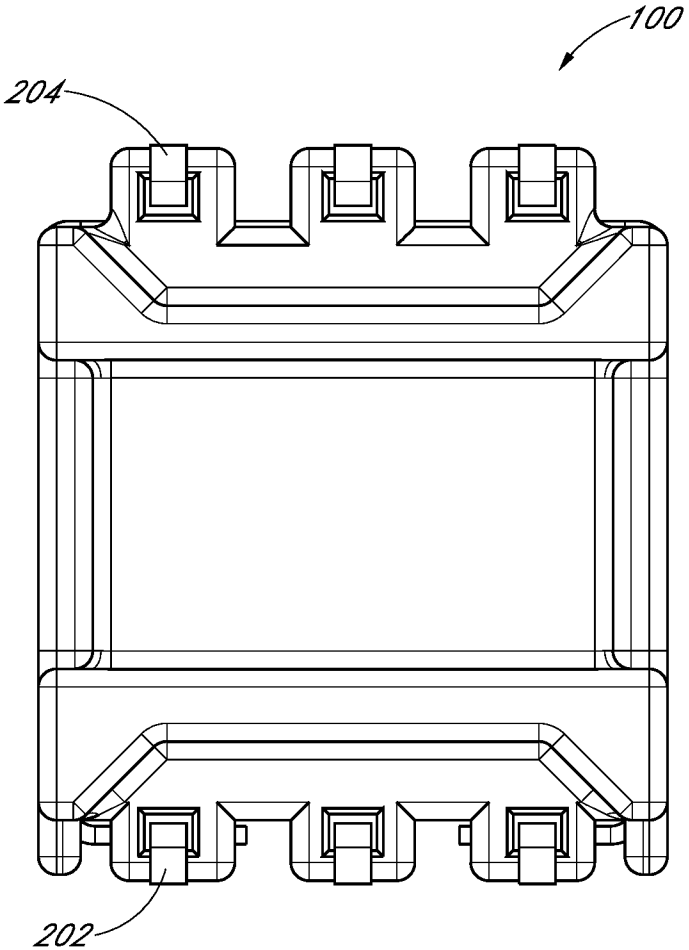

FIG. 3A illustrates a bottom down view of the housing 100. As described in FIG. 1, the transformer 400 may be connected to pins 204 which are the first terminal. The pins 204 may be spaced approximately 2.9 mm to 3.20 mm apart or approximately 3.00 mm to 3.10 mm apart. For example, in one embodiment, the pins 204 may be spaced approximately 3.05 mm apart. Alternatively, the pins 204 can be spaced apart a different amount depending on various factors which would benefit from a different spacing. The transformer 400 may be connected to pins 202 which are the second terminal. Similarly, the pins 202 may be spaced approximately 2.9 mm to 3.20 mm apart or approximately 3.00 mm to 3.10 mm apart. For example, in one embodiment, the pins 202 may be spaced approximately 3.05 mm apart. Alternatively, the pins 202 can be spaced apart a different amount depending on various factors which would benefit from a different spacing.

FIG. 3B illustrates a side view of the housing 100 from the front side 130 where the pins 202 that make up the second terminal are positioned. The wires 402 include at least two wires which are both connected to the transformer 400 and run alongside the body portion 200. The wires run alongside the body portion 200 in two separate grooves 210 which channel the wires to the pins 204 that make up the first terminal. As shown, the height of the housing 100 may be approximately 8.0 mm or less, approximately 7.5 mm or less, approximately 7.0 mm or less, approximately 6.5 mm or less, approximately 6.0 mm or less, between approximately 7.5 mm and approximately 8.0 mm, between approximately 7.0 mm and approximately 7.5 mm, between approximately 6.5 mm and approximately 7.0 mm, or between approximately 6.0 mm and approximately 6.5 mm. For example, in one embodiment, the height of the housing 100 may be approximately 6.8 mm. Further, the pins 202 may extend approximately 0.1 mm to 0.3 mm or 0.15 mm to 0.25 mm below the housing 100. For example, in one embodiment, the pins 202 may extend approximately 0.2 mm below the housing 100.

Figure 3D:
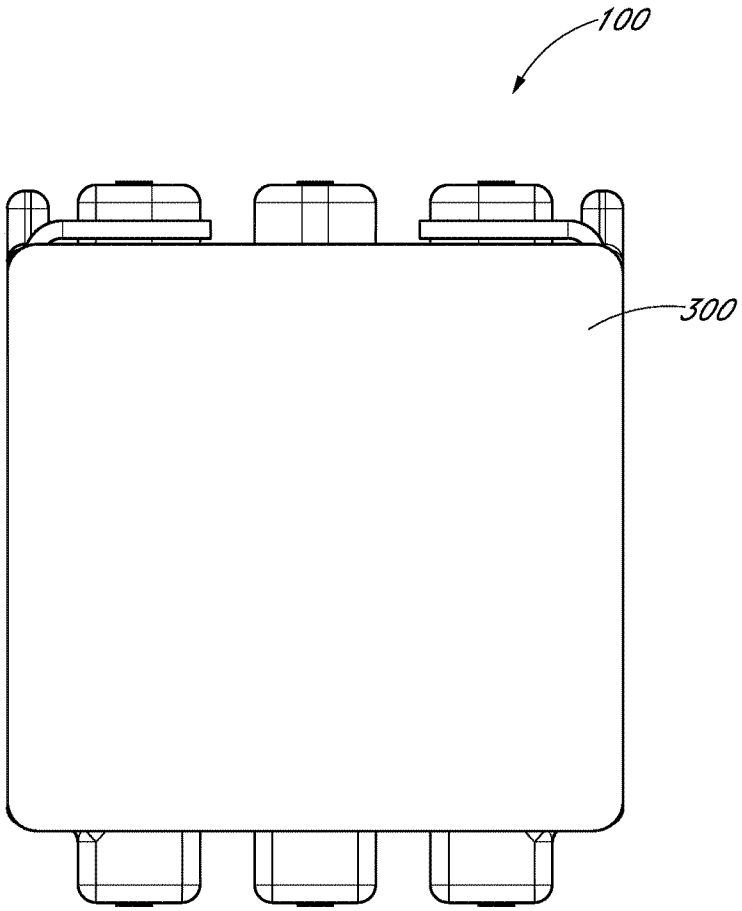
Figure 3C:
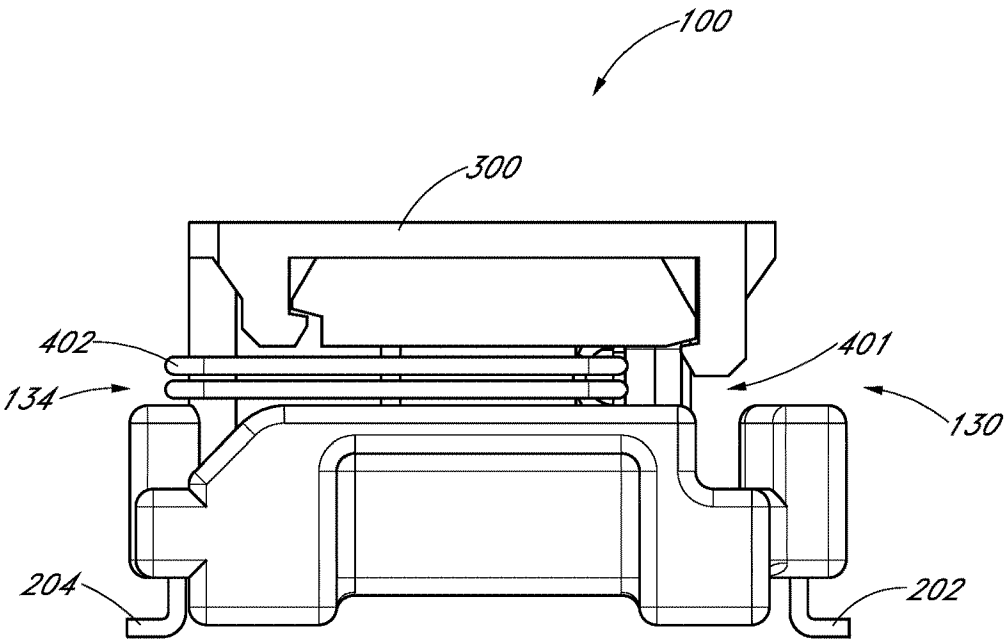

FIG. 3C illustrates another side view of the housing 100 from the lateral side 132 along which no pins may be provided. As shown, the pins 204 that make up the first terminal and the pins 202 that make up the second terminal may be provided on the opposing rear and front sides 134, 132, respectively. As displayed, the distance between the end of the pins 204 that make up the first terminal to the pins 202 that make up the second terminal may be approximately 13.1 mm or less, approximately 12.6 mm or less, approximately 12.1 mm or less, approximately 11.6 mm or less, approximately 11.1 mm or less, approximately 10.6 mm or less, between approximately 12.6 mm and approximately 13.1 mm, between approximately 12.1 mm and approximately 12.6 mm, between approximately 11.6 mm and approximately 12.1 mm, between approximately 11.1 mm and approximately 11.6 mm, or between approximately 10.6 mm and approximately 11.1 mm. For example, in one embodiment, the distance between the end of the pins 204 that make up the first terminal to the pins 202 that make up the second terminal may be approximately 12.2 mm. Alternatively, the distance between the ends of the pins 202 and pins 204 can be different depending on various factors. An example would be, depending on the size of the transformer 400 the housing 100 size can change which would alter the distance between the pins 202 and pins 204. Also as displayed, the pins 202 and 204 can have an extending portion which may have a length of approximately 0.4 mm to approximately 0.8 mm or 0.5 mm to approximately 0.7 mm. For example, in one embodiment, the extending portion may have a length of approximately 0.6 mm. Alternatively, the extending portion can have a length of a different amount depending on various factors. For example, different connectors adapted for use with the pins 202, 204 may have different lengths and therefore it would be advantageous to use pins adapted for the different lengths.

FIG. 3D illustrates a top down view of the housing 100. As displayed, the depth of the housing 100 may be approximately 13.0 mm or less, approximately 12.5 mm or less, approximately 12.0 mm or less, approximately 11.5 mm or less, approximately 11.0 mm or less, approximately 10.5 mm or less, between approximately 12.5 and approximately 13.0 mm, between approximately 12.0 and approximately 12.5 mm, between approximately 11.5 and approximately 12.0 mm, between approximately 11.0 and approximately 11.5 mm, or between approximately 10.5 and approximately 11.0 mm. For example, in one embodiment, the depth of the housing 100 may be approximately 12.1 mm. Further displayed, the width of the housing 100 may be approximately 11.5 mm or less, approximately 11.0 mm or less, approximately 10.5 mm or less, approximately 10.0 mm or less, approximately 9.5 mm or less, approximately 9.0 mm or less, between approximately 11.0 mm and approximately 11.5 mm, between approximately 10.5 mm and approximately 11 mm, between approximately 10.0 mm and approximately 10.5 mm, between approximately 9.5 mm and approximately 10.0 mm, or between approximately 9.0 mm and approximately 9.5 mm. For example, in one embodiment, the width of the housing 100 may be approximately 10.4 mm. Alternatively, the width and depth of the housing 100 can vary based on a number of different factors. For example, the size of the transformer 400 housed in the housing 100 can change and the housing could be adapted to accommodate the change in size.

Figure 3E:
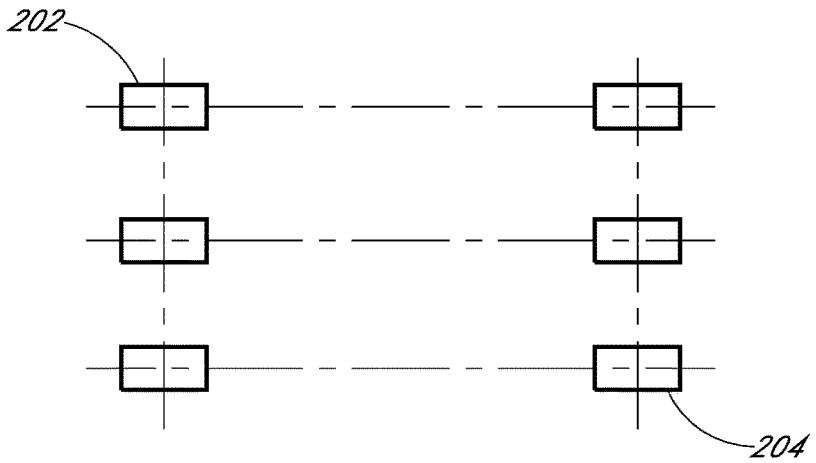

FIG. 3E is a schematic of a cross-sectional view of pins 202, 204 in order to illustrate the dimensions and spacing of the pins 202, 204. As shown, the spacing between the center of pins 202 to the center of pins 204 may be approximately 12.6 mm or less, approximately 12.1 mm or less, approximately 11.6 mm or less, approximately 11.1 mm or less, approximately 10.6 mm or less, approximately 10.1 mm or less, between approximately 12.1 mm and approximately 12.6 mm, between approximately 11.6 mm and approximately 12.1 mm, between approximately 11.1 mm and approximately 11.6 mm, between approximately 10.6 mm and approximately 11.1 mm, or between approximately 10.1 mm and approximately 11.6 mm. For example, in one embodiment, the spacing between the center of pins 202 to the center of pins 204 may be 11.10 mm. Further, the spacing from the center of directly adjacent pins 202 may be 2.9 mm to 3.20 mm apart or approximately 3.00 mm to 3.10 mm apart. For example, in one embodiment, the spacing form the center of directly adjacent pins 202 may be 3.05 mm. The spacing from the center of directly adjacent pins 204 can be similarly space to that of pins 202. The pins 202, 204 each have a rectangular shape. The width of pins 202, 204 may have a width of between approximately 1.9 mm to approximately 2.1 mm or approximately 1.95 mm to approximately 2.05 mm. For example, in one embodiment, the pins 202, 204 may have a width of approximately 2 mm. The length dimension of the pins 202, 204 may be approximately 0.9 mm to approximately 1.1 mm or 0.95 mm to approximately 1.05 mm. For example, in one embodiment, the pins 202, 204 may have a length dimension of approximately 1.0 mm. Alternatively, the dimensions and spacing can be altered based on design constraints. For example, running a higher voltage through the pins 202, 204 could benefit from more spacing between the pins 202, 204 and therefore spacing could be altered.

Figure 3F:
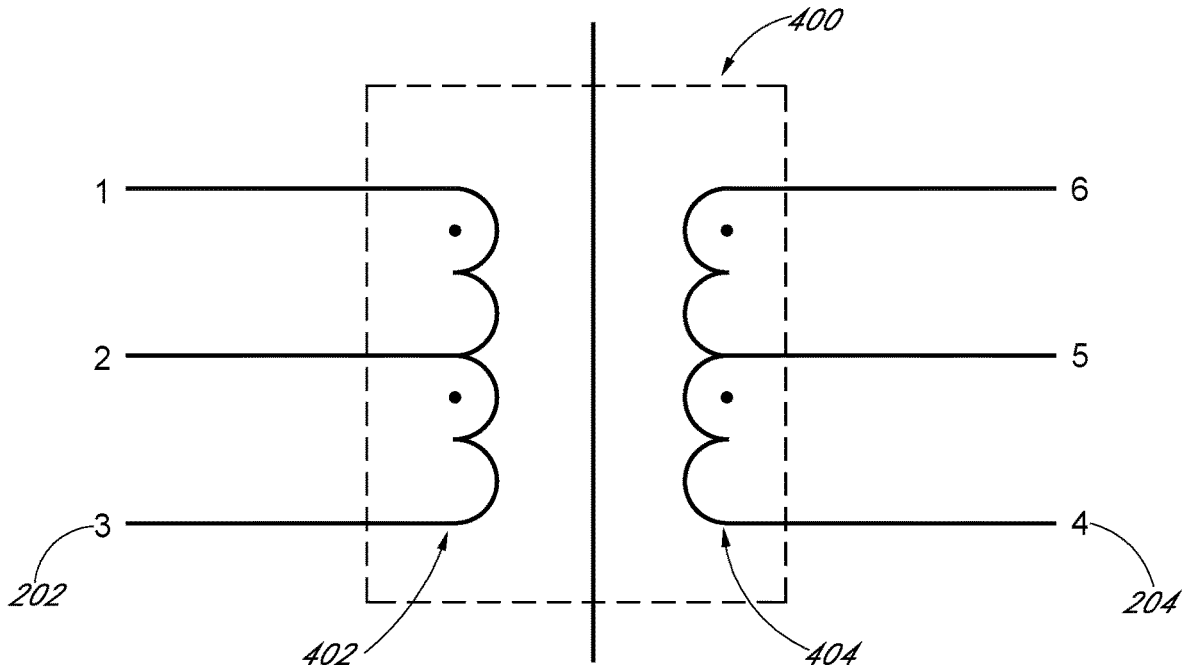

FIG. 3F is a schematic representation of the transformer 400 connected to the pins 202 and pins 204. As discussed previously, the transformer 400 includes two sets of windings, a primary winding 402 and a secondary winding 404. The transformer 400 is illustrated by components captured within the dotted line. The pins 202 are connected to the primary winding 402 whereas the pins 204 are connected to the secondary winding 404. In particular, pins labelled 1, 2, and 3 may correspond to pins 202 and may be respectively coupled to the beginning, middle, and end of a primary winding in transformer 400, while pins labelled 4, 5, and 6 may correspond to pins 204 and may be respectively coupled to the beginning, middle, and end of a secondary winding in transformer 400. In general, references herein to primary and secondary may be used interchangeably (e.g., the secondary side may, if desired, be operated as the primary side and the primary side may be operated as the secondary side).

Figure 4A:
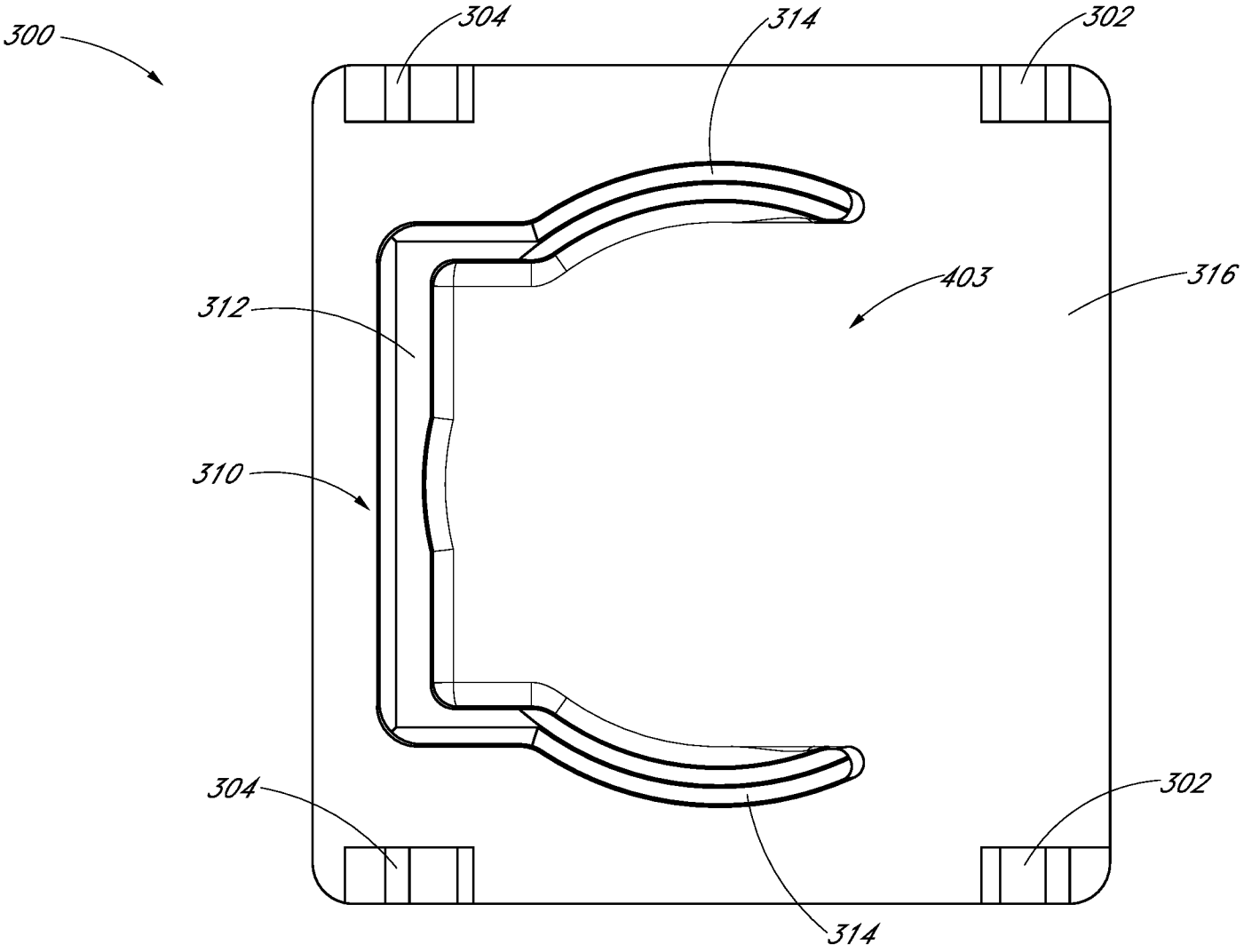
FIG. 4A is a bottom-up view of a lid portion of the electronic component housing of FIG. 1.
Figure 4B:
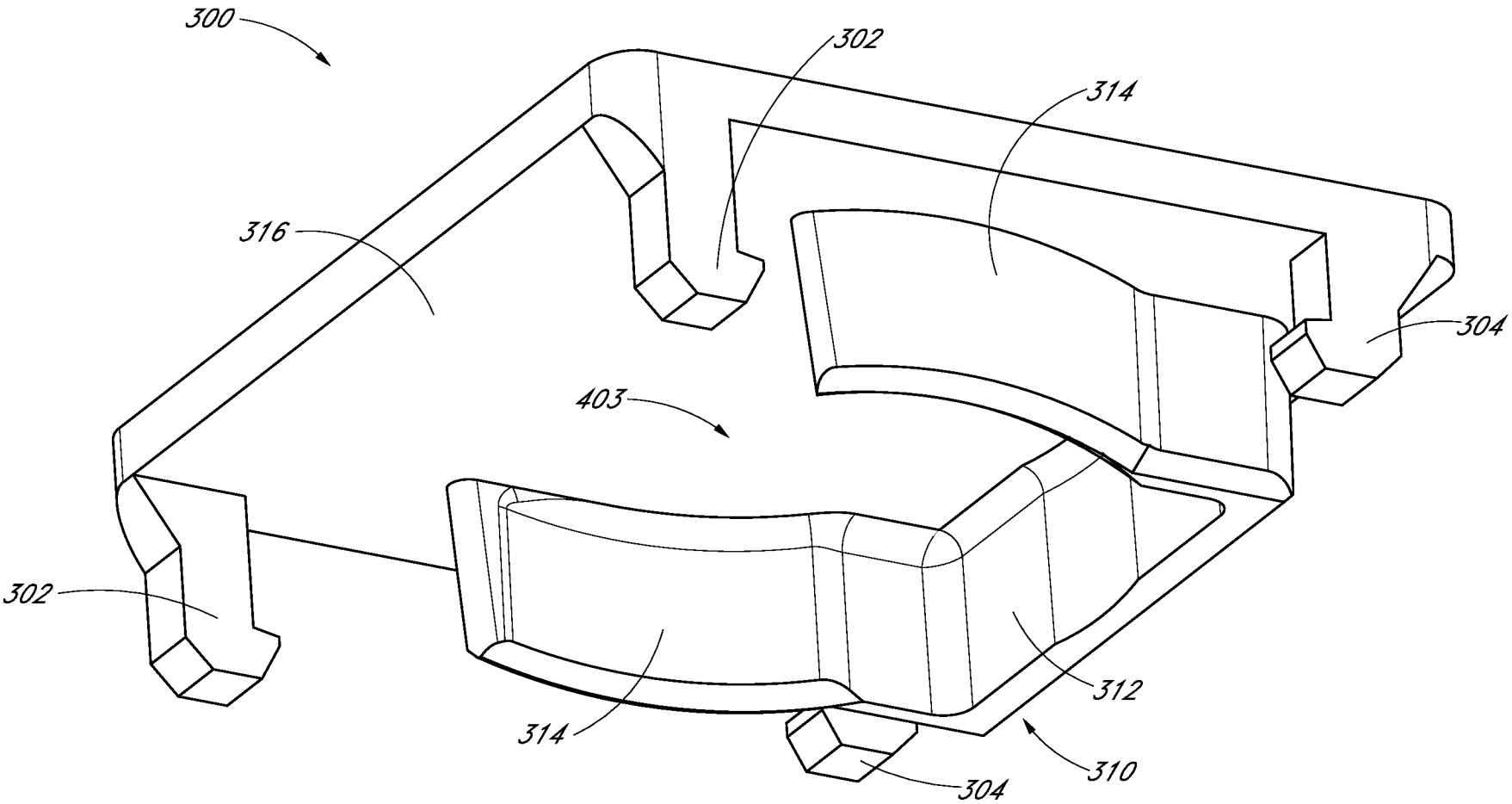
FIG. 4B is a perspective view of the lid portion of FIG. 4A.

FIG. 4A is a bottom perspective view of the lid portion 300 of FIG. 1. FIG. 4B illustrates a perspective view of the lid portion 300 of FIG. 1. The lid portion 300 includes engagement members 302 and 304 which engage with respective engagement portions of the body portion 200 (not shown). The lid portion 300 also features an extension portion 310 which extends into the cavity of the body from a lateral portion 316 of the lid portion 300 and secures with a vertically formed sidewall 218 of the body portion 200. When the lid portion 300 is secured with body portion the vertically formed extension portion or fin and the vertically formed sidewall of the body are adjacent with each other. When the vertically formed sidewall and the vertically formed fin are adjacent with one another, they are substantially parallel with a small gap separating the sidewall from the extension portion or fin. In other embodiments, the lid portion 300 and body portion 200 can be dimensioned such that the extension portion 310 and sidewall 218 contact one another. Advantageously, the vertically formed fin or extension portion 310 of the lid portion 300 and the vertically formed sidewall 218 of the body increase the length of the minimum creepage path as described in FIG. 2.

In some embodiments, the extension portion 310 has a substantially rectangular shape with three sides that are integrally formed. The extension portion 310 can also be other shapes in order to accommodate various electrical components housed within the housing 100. The extension 310 can also include more or less than three sides. Beneficially, the extension 310 can have a rounded shape on two rounded wall portions 314 extending from two ends of a center wall portion 312. When the body portion 400 has a corresponding rounded shape on corresponding sidewalls, this feature stabilizes the lid portion 300 when the lid portion 300 is secured within the body portion 400 by preventing the lid portion 300 from sliding. The extension portion 310 includes a lid opening 403 defined between terminating ends of the wall portions 314. When the lid portion 300 is secured to the body portion 400, the lid opening 403 of the extension portion 310 and an opening of the sidewall 218 of the body (not shown) can cooperate to at least partially define the front opening 401 in the housing 100 to provide access or to expose the electrical component therein.

Figure 5A:
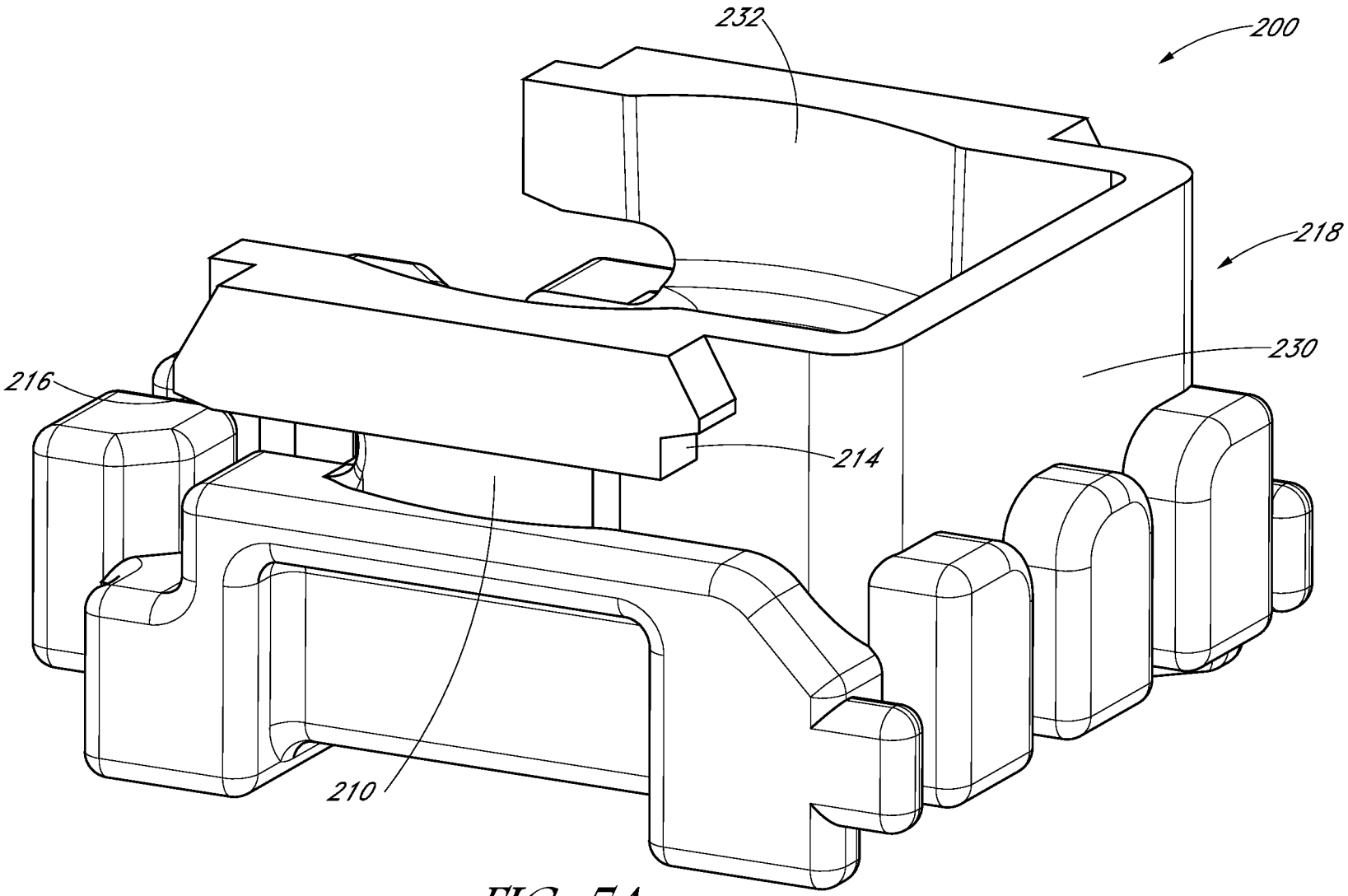
FIG. 5A is a perspective view of a body portion of the electronic component housing of FIG. 1, showing a back side of the body portion.

FIG. 5A is a perspective view of the body portion 200, showing the rear and side of the body portion 200. The side of body portion 200 may include groove 210 for routing wire 402 (not shown). This groove 210 holds and routes the wire 402 to the pins 204 (not shown) that make up the first terminal. The body portion 200 includes engagement portions 214 and 216 which engage with the engagement members 302 and 304 of the lid portion 300 in order to secure the lid portion 300 to the body portion 200. While one side of the body portion 200 is depicted, the body portion 200 may be symmetrical and therefore the other side may have the same features. Alternatively, the body portion 200 can be designed to be unsymmetrical where the features on the other side would be different from those of the one side.

The body portion 200 includes a vertically formed sidewall 218 extending from a lateral base 236. Advantageously, the extension portion 310 (not shown) of the lid portion 300 and the vertically formed sidewall 218 of the body portion 200 increase the length of the minimum creepage path as described in FIG. 2. Like the extension 310 of the lid portion 300, the vertically formed sidewall 218 is substantially rectangular shaped and surrounds three sides. The vertically formed sidewall 218 can also be other shapes in order to accommodate various electrical components housed within the housing 100. The vertically formed sidewall 218 may have a rounded shape on two parallel rounded walls portions 232 extending from two ends of a center wall portion 230 which mirrors the extension 310 of the lid portion 300. As described above, the rounded shape stabilizes the lid portion 300 when the lid portion 300 is secured within the body portion 400.

Figure 5B:
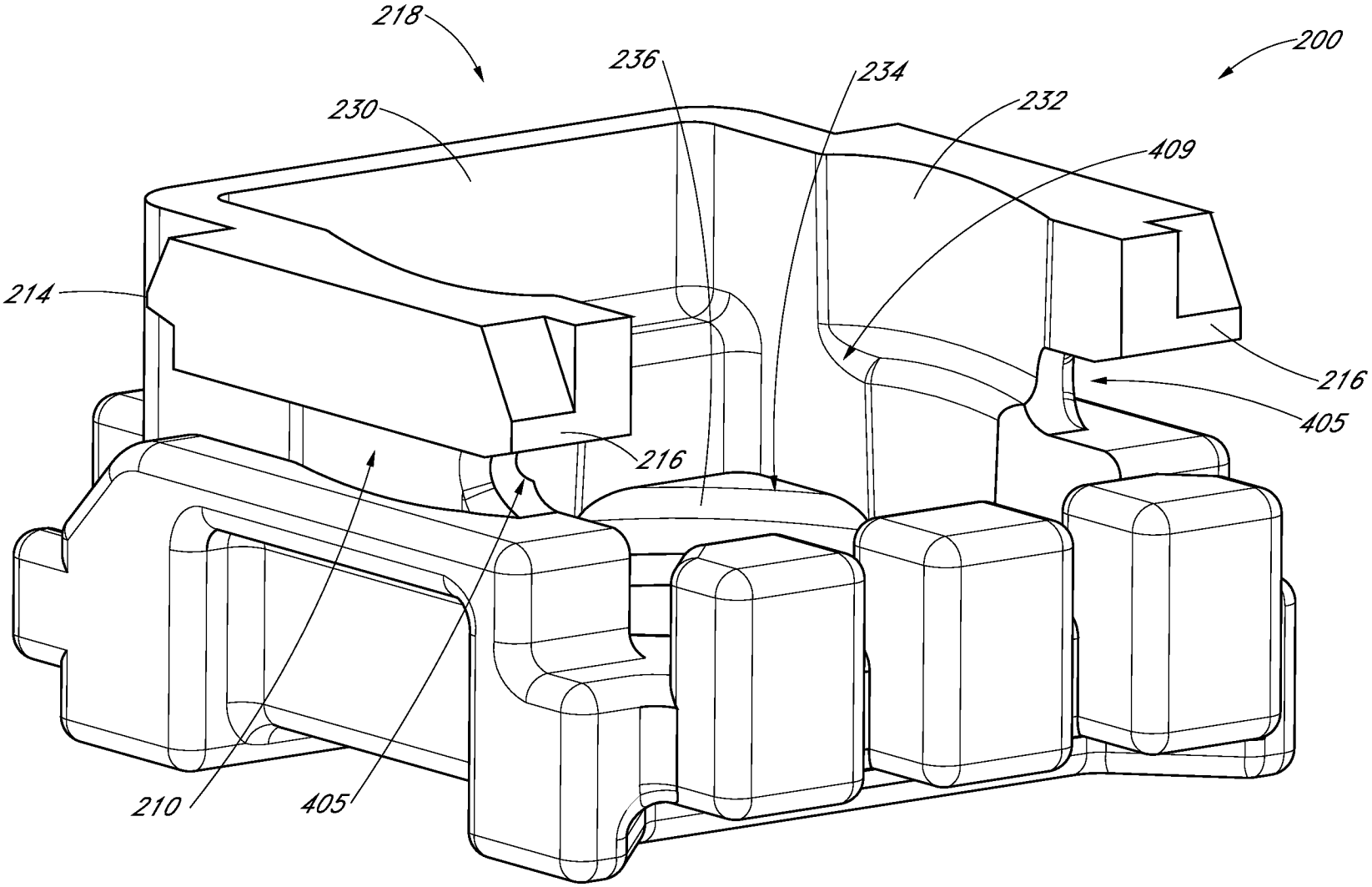
FIG. 5B is a perspective view of the body portion of FIG. 5A, showing a front side of the body portion.

FIG. 5B is a perspective view of the body portion 200, showing the front and side of the body portion 200. FIG. 5B shares the features of FIG. 5A and therefore these features will not be repeated. The body portion 200 includes a cavity 234 which houses an electrical component, such as the transformer 400. The body portion 200 includes a vertically formed sidewall 218 disposed along three sides. The vertically formed sidewall 218 comprises a body opening 409, which cooperates with the lid opening 403 to at least partially define the front opening 401 of the housing 100. Beneficially, leaving the front side 130 of the housing 100 open (for example, by way of front opening 401) can permit the evaporation of liquids used during assembly (such as a post soldering wash). Additionally, the design of housing 100 may at least partially protect the wire 402 from solder heat. The sidewalls 218 can further include sidewall openings 405. When the lid portion 300 is engaged to the body portion 200, the engagement members 302 of the lid portion 300 can cooperate with the sidewall openings 405 of the body portion 200 to define the side openings 133*a*, 133*b*. The wires 402 (not shown) can pass through the side openings 133*a*, 133*b* where they can be routed along respective sides 132, 136 of the housing 100.

Figure 6:
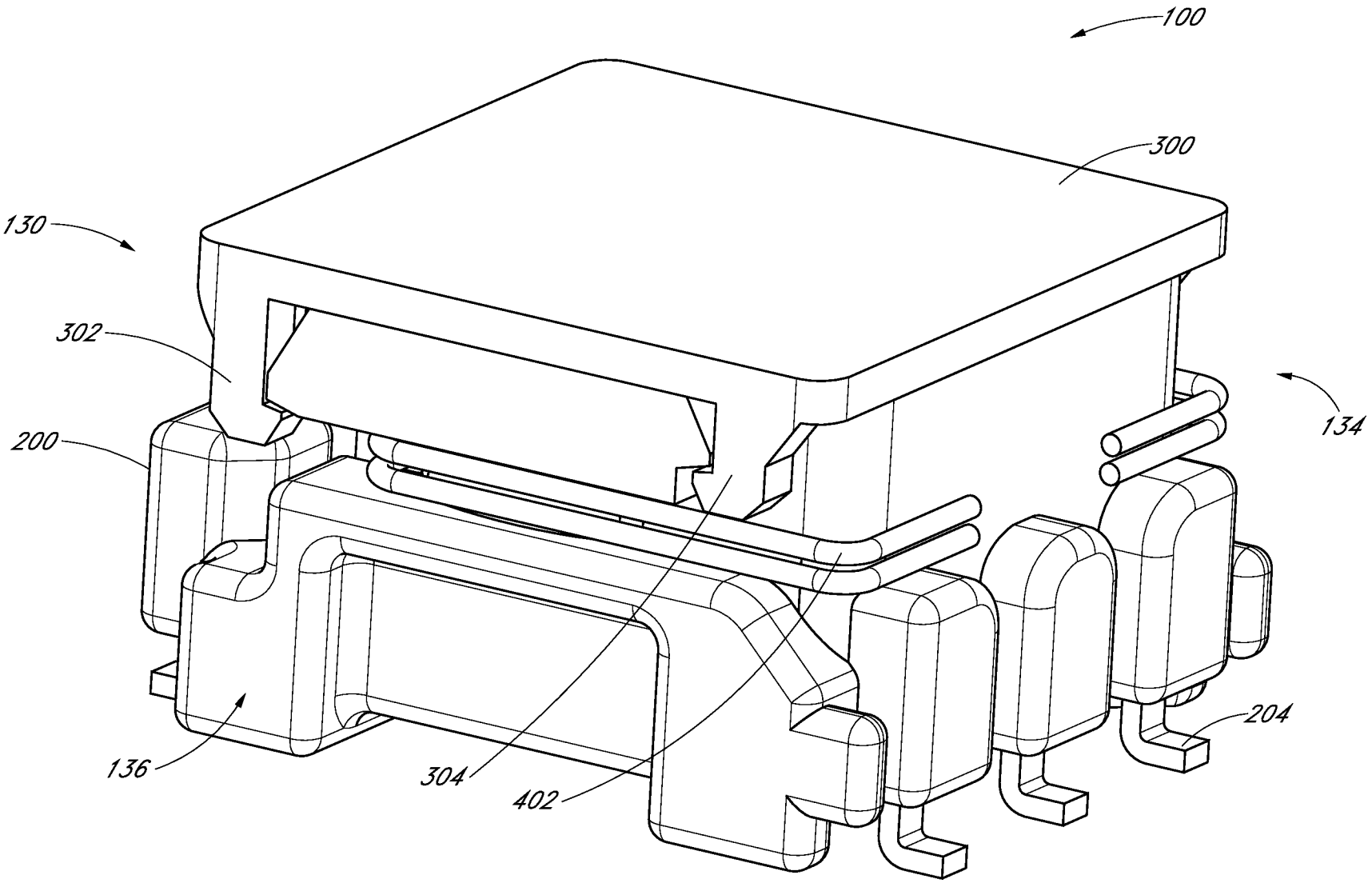
FIG. 6 is a rear perspective view of the electronic component housing of FIG. 1, showing the lid portion coupled to the body portion.

FIG. 6 is a rear perspective view of the assembled housing 100 with component 400 similar to the view shown in FIG. 1. FIG. 6 has all the features of FIG. 1 and therefore will not be repeated. As shown, wires 402 may be routed along opposing sides 132, 136 of the housing 100 and may be secured within grooves 210 by engagement portions 302. Further, when the lid portion 300 is secured to the body portion 400, the lid portion 300 may also protect and/or secure wire 402 in place. The engagement member 302 of the lid portion 300 may, in addition to securing lid portion 300 to the body portion 200, serve as a locking feature that secures the wire 402 in place when the lid portion 300 is secured to the body portion.

Figure 7:
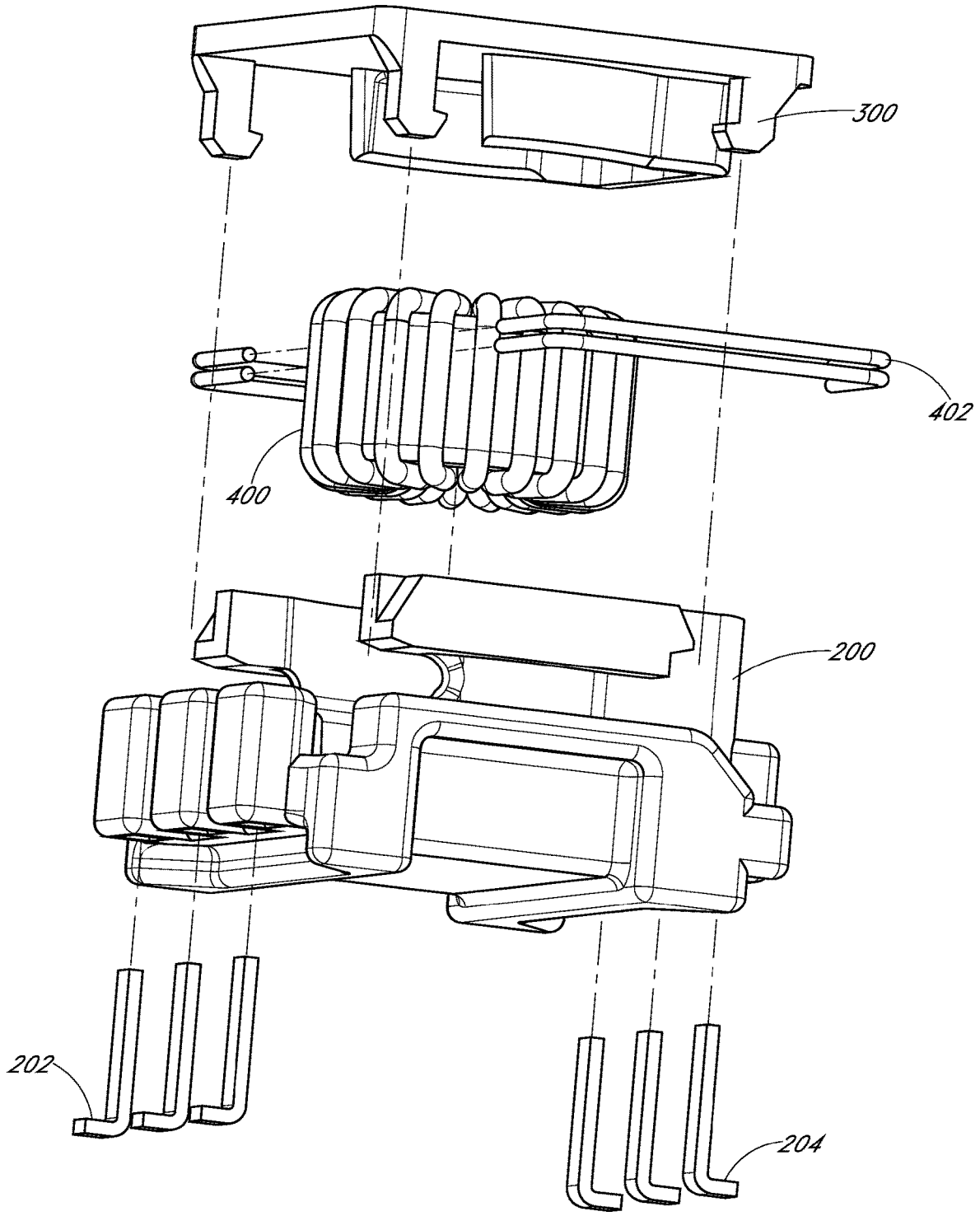
FIG. 7 is an exploded perspective view of the electronic component housing and electronic component of FIG. 1.

FIG. 7 is an exploded perspective view of the assembled housing 100 with component 400. FIG. 7 has all the features described in FIGS. 1 and 6 and therefore will not be repeated.

In some embodiments, the housing 100 and component 400 provided herein may provide minimum creepage and minimum clearance distances of at least 8 mm between the primary and secondary windings and pins 202 which make up the first terminal, enabling operation at a working voltage of 400V.

Figure 8:
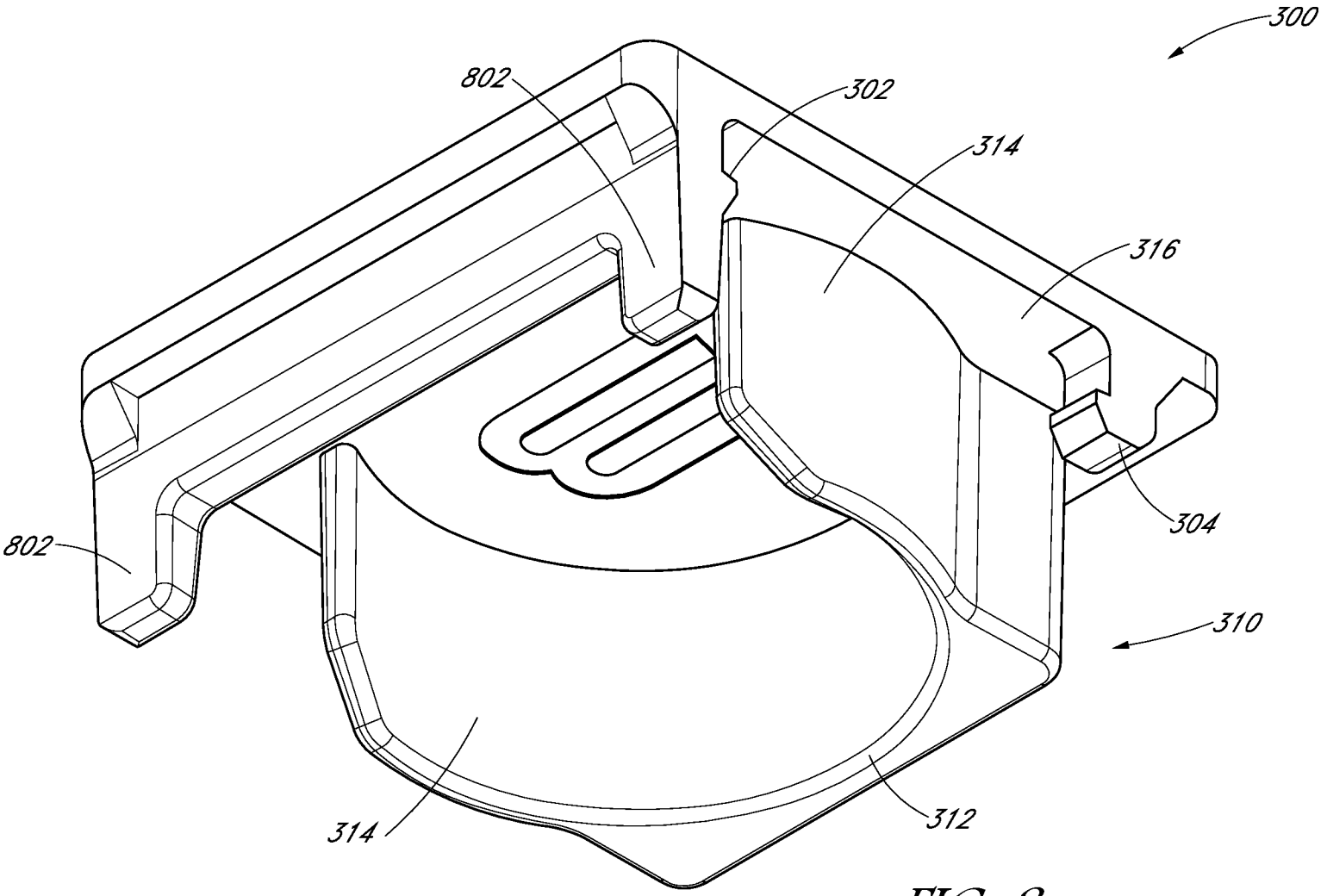
FIG. 8 is a perspective view of an exemplary embodiment of a lid portion of a housing, according to another embodiment.

FIG. 8 is a bottom side perspective view of an exemplary lid portion 300. The lid portion 300 of FIG. 8 is similar to the lid portion 300 described above in FIGS. 4A and 4B. Unless otherwise noted, reference numerals in FIG. 8 refer to components that are the same as or generally similar to like-numbered components of FIGS. 1-7. The lid portion 300 illustrated in FIG. 8 also has tabs 802 which extend from the engagement members 302. When the lid portion 300 is secured to the body portion 400 (not shown), the wire 402 (not shown) can be secured between the tab 802 and the body portion 400. The lid portion 300 illustrated in FIG. 8 includes a longer extension portion 310 when compared to the extension portion 310 of the lid portion 300 of FIGS. 4A and 4B. As discussed in FIG. 10, the longer extension portion 310 can further increase the minimum creepage path.

Figure 9:
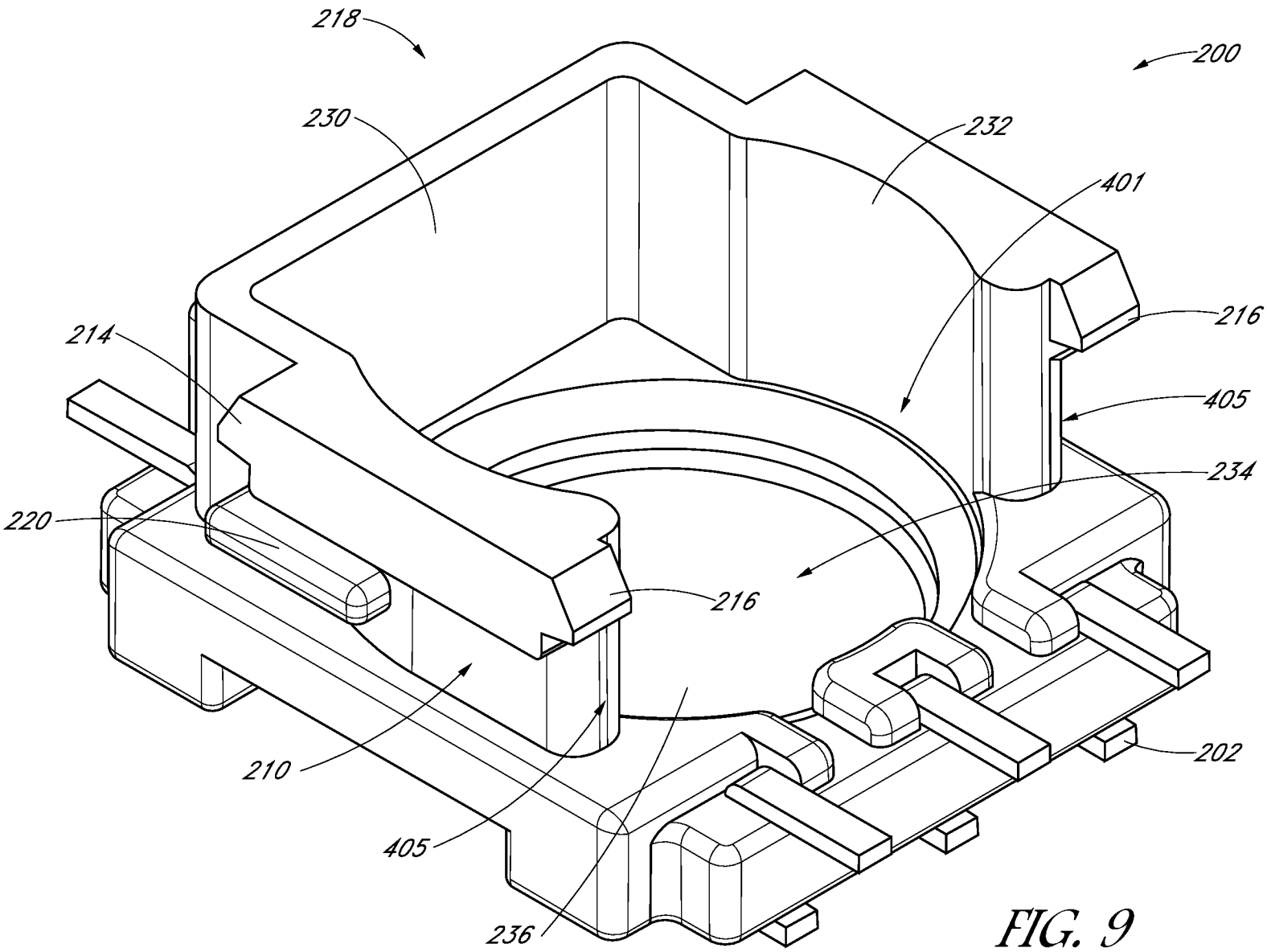
FIG. 9 is a perspective view of an exemplary embodiment of a body portion configured to mate with the lid portion of FIG. 8.

FIG. 9 is a top side perspective view of an exemplary body portion 200. The body portion 200 of FIG. 9 is similar to the body portion 200 described above in FIGS. 5A and 5B. Their shared features are identified with the same reference numbers and will not be reiterated here. The body portion 200 of FIG. 9 is adapted to correspond to the lid portion 300 of FIG. 8. As previously discussed, the lid portion 300 of FIG. 8 has a longer extension portion 310 when compared to the extension portion 310 of the lid portion 300 of FIGS. 4A and 4B. Thus, the sidewall portion 218 of the body portion 200 has a shape that corresponds to the longer lid portion 300. The body portion 200 further includes a protruding portion 220 in the groove 210 which can divide multiple wires 402 when multiple wires 402 are housed in the groove 210. Beneficially, by dividing the multiple wires 402, the wires 402 are less likely to get tangled which can aid in assembly of the device. Also displayed is the pin 202 that make up the second terminal. In the illustrated embodiment, the housing size for the pins 202 has been reduced and the pins 202 extend vertically from two ends of the housing.

Figure 10:
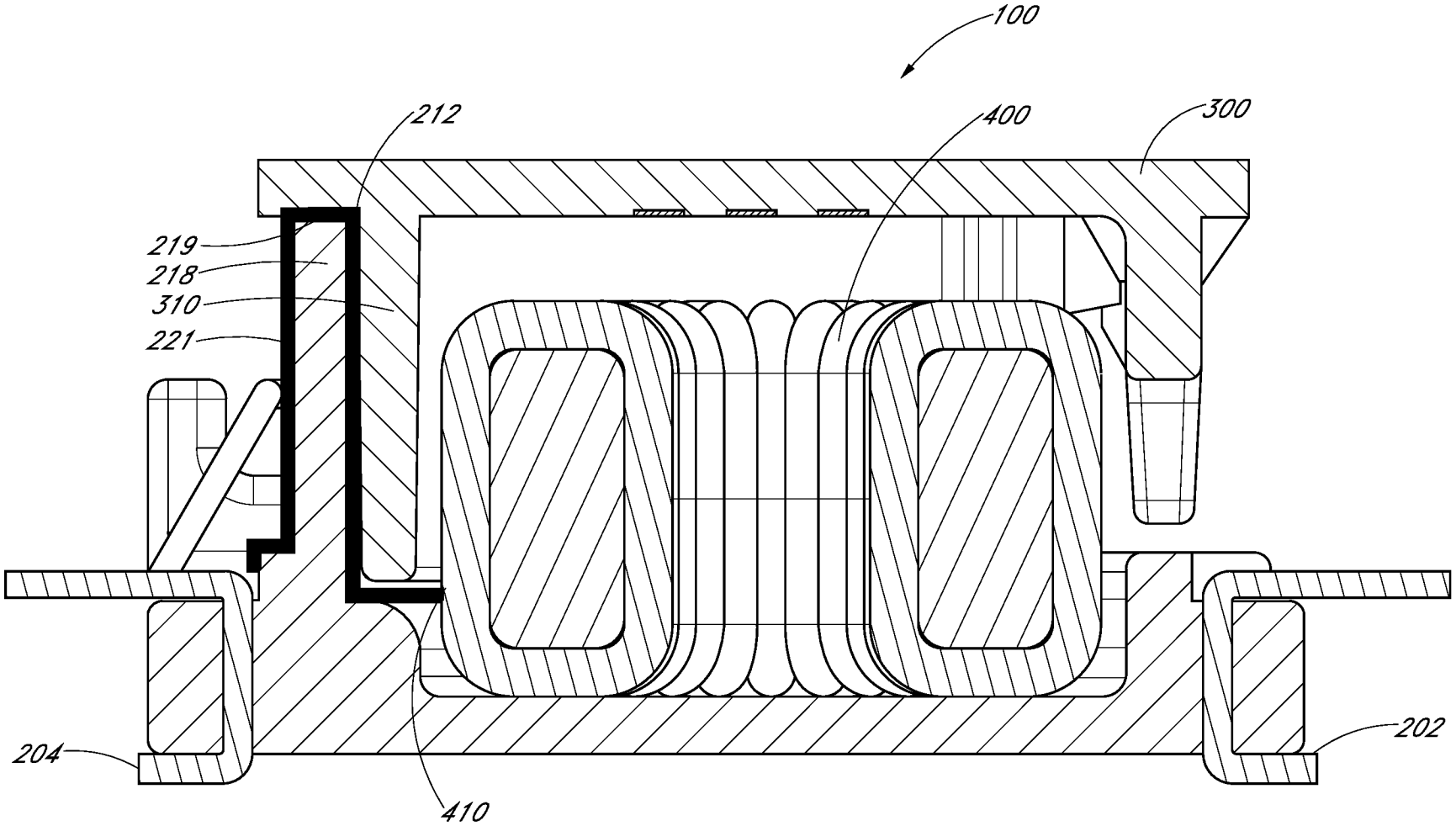
FIG. 10 is a cross-sectional side view of an exemplary embodiment of the housing of FIGS. 8 and 9 with a transformer disposed therein, and also schematically showing a minimum creepage path.

FIG. 10 is a cross-sectional view of an exemplary housing 100 and transformer 400 disposed in the housing 100. The housing 100 includes the lid portion 300 of FIG. 8 and the body portion 200 of FIG. 9. Further, the housing 100 and transformer 400 of FIG. 10 are similar to those described above in FIG. 2 and therefore the shared features will not be described again in detail. As described in the description of FIG. 8, the lid portion 300 of FIG. 8 has a longer extension portion 310 when compared to the extension portion 310 of the lid portion 300 of FIGS. 4A and 4B. Further described in the description of FIG. 9, the body portion 200 is adapted to mate with the lid portion 300. The longer extension portion 310 displayed in FIG. 10 provides a minimum creepage path 212 in the housing 100 that is greater than the minimum creepage path 212 of FIG. 2. As shown in FIG. 10, the minimum creepage path 212 of FIG. 10 extends from a location 410 near the bottom of the transformer 400 whereas the minimum creepage path 212 of FIG. 2 starts from a location closer to the top of the transformer 400. A longer minimum creepage path 212 allows the housing 100 and transformer 400 of FIG. 10 to conform to minimum creepage path regulatory specifications while maintaining a device with compact dimensions.

Figure 11:
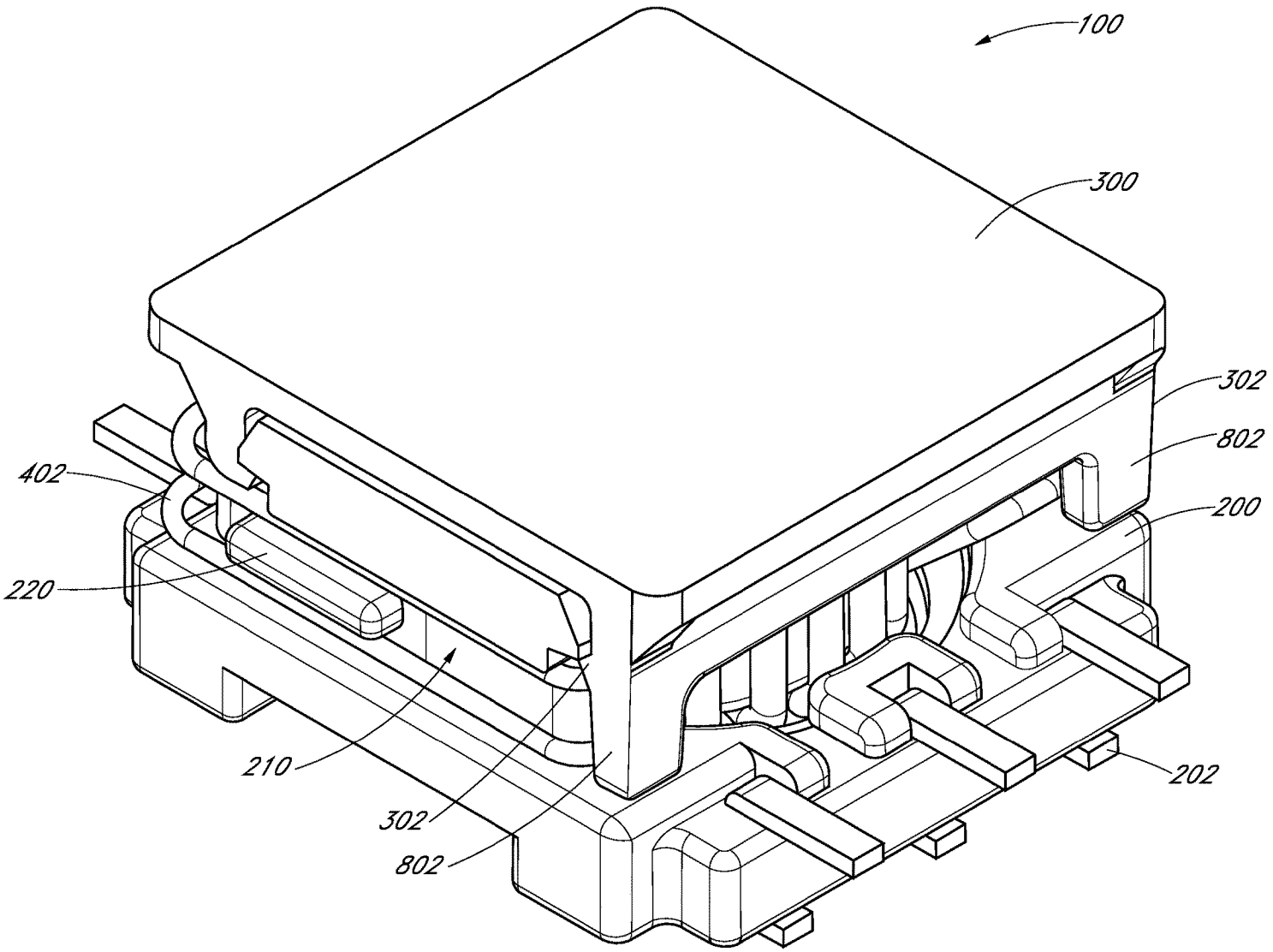
FIG. 11 is a perspective view of the housing and transformer of FIG. 10.
Figure 12:
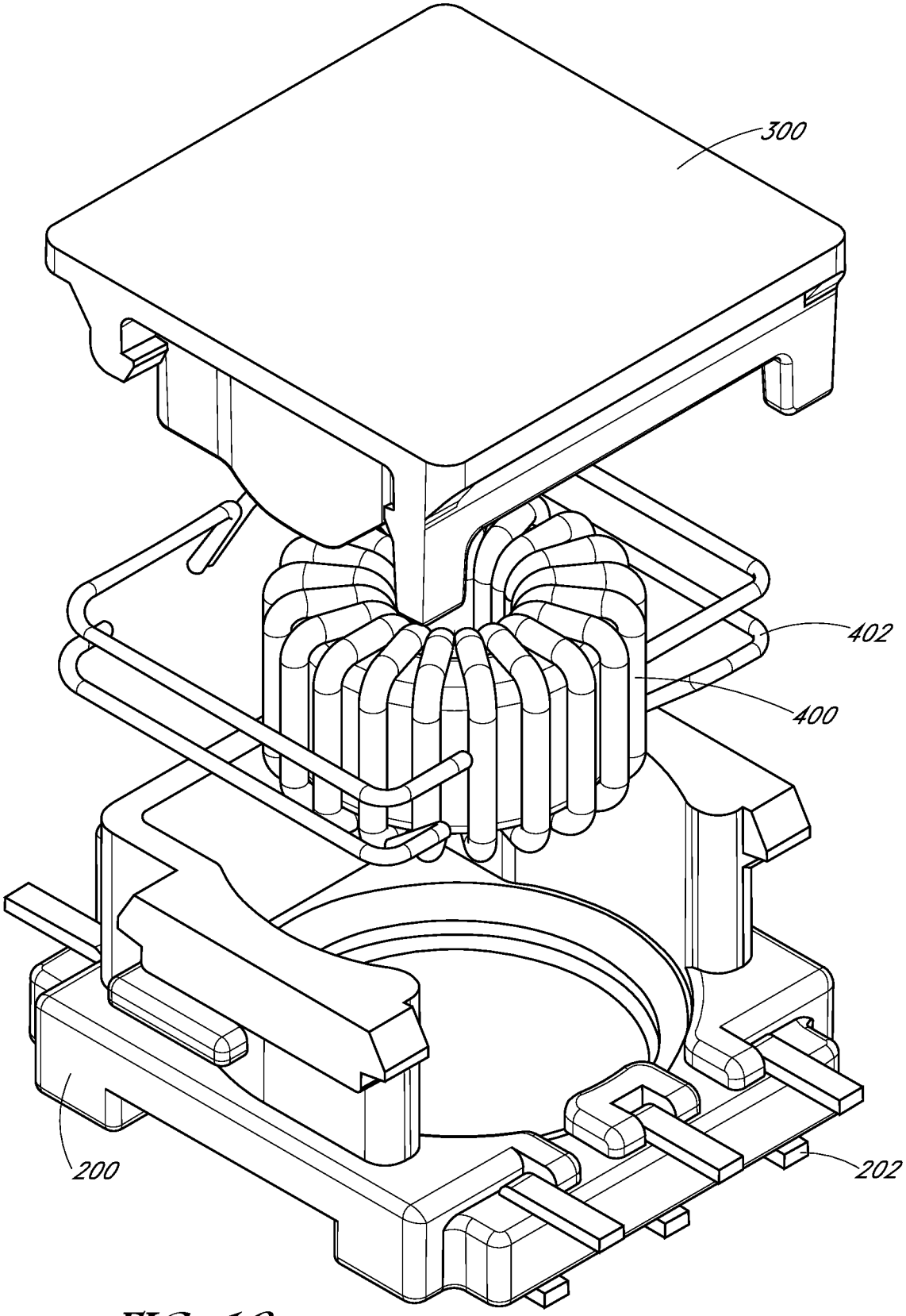
FIG. 12 is an exploded perspective view of the housing and transformer of FIGS. 10 and 11.

FIG. 11 is a perspective view of the housing 100 and transformer 400 disposed in the housing of FIG. 10. The housing 100 includes the lid portion 300 of FIG. 8 and the body portion 200 of FIG. 9. The housing 100 and transformer 400 of FIG. 11 are similar to those described above in FIG. 6 and therefore the shared features will not be described again in detail. The body portion 200 includes the protruding portion 220 in the groove 210. As described above, the protruding portion 220 can divide multiple wires 402 coming from the transformer 400. Dividing wires 402 can reduce the chances of tangling which can reduce the chances of crosstalk. Further, the lid includes tabs 802 which secure the wires 402 between the tabs 802 and the body portion 200. FIG. 12, is an exploded perspective view of the housing 100 and transformer 400 disposed in the housing 100 of FIG. 11.

Although this invention has been disclosed in the context of certain embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A low-profile electronic component housing comprising:

a body comprising a cavity;

an electronic component housed in the cavity of the body;

a lid secured to the body, the lid comprising an extension portion that extends into the cavity of the body from a lateral portion of the lid;

a wire; and a terminal electrically coupled to the electronic component by way of the wire, wherein a minimum creepage path is disposed between the terminal and the electronic component, the minimum creepage path comprising a distance between the terminal and the electronic component as measured along a surface of insulation, and wherein the minimum creepage path extends along the extension portion of the lid.

2. The electronic component housing of claim 1, wherein the electronic component comprises a wire-wound electronic component.

3. The electronic component housing of claim 2, wherein the wire-wound electronic component comprises a transformer.

4. The electronic component housing of claim 1, wherein the minimum creepage path extends between the extension portion and the body.

5. The electronic component housing of claim 1, wherein the wire is routed along a lateral side of the electronic component housing.

6. The electronic component housing of claim 5, wherein the wire is routed into the cavity through a side opening disposed on the lateral side of the electronic component housing.

7. The electronic component housing of claim 6, wherein no terminals are disposed along the lateral side of the electronic component housing.

8. The electronic component housing of claim 6, wherein the body further comprises a sidewall.

9. The electronic component housing of claim 8, wherein the sidewall and the extension portion extend vertically in opposing directions.

10. The electronic component housing of claim 9, wherein the extension portion comprises two rounded wall portions extending from two ends of a center wall portion.

11. The electronic component housing of claim 8, wherein the electronic component housing has a front side disposed non-parallel relative to the lateral side, wherein the sidewall and the lid cooperate to define a front opening in the front side which exposes the electronic component to an exterior of the electronic component housing.

12. The electronic component housing of claim 11, further comprising another terminal comprising a plurality of pins disposed along the front side of the electronic component housing.

13. The electronic component housing of claim 1, wherein the lid further comprises a locking feature that secures the lid to the body and at least partially secures the wire against a portion of the body.

14. The electronic component housing of claim 1, wherein the wire comprises an insulated wire.

15. A low-profile electronic component housing, comprising:

a body having a base and a sidewall extending non-parallel relative to the lateral base;

an electronic component housed within a cavity of the body;

a lid secured to the body, the lid comprising an extension portion extending towards the body along the sidewall from a lateral portion of the lid; and a terminal electrically coupled to the electronic component by way of a wire, wherein a minimum creepage path is disposed between the terminal and the electronic component, the minimum creepage path comprising a distance between the terminal and the electronic component as measured along a surface of insulation.

16. The low-profile electronic component housing of claim 15, wherein the electronic component comprises a wire-wound electronic component.

17. The low-profile electronic component housing of claim 16, wherein the wire-wound electronic component comprises a transformer.

18. The low-profile electronic component housing of claim 15, wherein the extension portion and the sidewall are at least partially disposed around the electronic component.

19. The low-profile electronic component housing of claim 15, further comprising another terminal electrically coupled to the electronic component.

20. The low-profile electronic component housing of claim 19, wherein the another terminal is disposed along a front side of the housing, the front side including a front opening that exposes the electronic component to an exterior of the housing.

21. The low-profile electronic component housing of claim 20, wherein the another terminal is electrically coupled to the electronic component through the front opening.

22. The low-profile electronic component housing of claim 21, wherein the wire is routed along a lateral side of the housing and extends into the housing through a side opening in the lateral side of the housing, the lateral side disposed non-parallel relative to the front side.

23. The low-profile electronic component housing of claim 22, wherein the lid at least partially secures the wire to the body and includes at least one tab which secures the wire between the tab and the body when the lid is secured to the body.

24. The low-profile electronic component housing of claim 15, wherein the terminal is positioned on a side of the extension portion and sidewall that is opposite the cavity.

25. A low-profile electronic component housing, comprising:

a body having a base and a sidewall disposed non-parallel relative to the base;

an electronic component housed within a cavity;

a lid secured to the body over the cavity and the electronic component, the lid comprising an engagement member that extends towards the base from a lateral portion of the lid;

a wire extending through a side opening between the engagement member and the sidewall; and a terminal electrically coupled to the electronic component by way of the wire, wherein a minimum creepage path is disposed between the terminal and the electronic component, the minimum creepage path comprising a distance between the terminal and the electronic component as measured along a surface of insulation.

* * * * *